US005679224A

United States Patent [19]

Sekhar

[11] Patent Number: 5,679,224

[45] Date of Patent: *Oct. 21, 1997

[54] TREATED CARBON OR CARBON-BASED CATHODIC COMPONENTS OF ALUMINUM PRODUCTION CELLS

[75] Inventor: Jainagesh A. Sekhar, Cincinnati, Ohio

[73] Assignee: Moltech Invent S.A., Luxembourg, Luxembourg

[ * ] Notice: The term of this patent shall not extend beyond the expiration date of Pat. No. 5,578,174.

[21] Appl. No.: 532,785

[22] PCT Filed: Nov. 23, 1993

[86] PCT No.: PCT/US93/11380

§ 371 Date: Oct. 6, 1995

§ 102(e) Date: Oct. 6, 1995

[87] PCT Pub. No.: WO94/24337

PCT Pub. Date: Oct. 27, 1994

[51] Int. Cl.[6] ..... C25D 17/00; C25B 11/12; C25C 7/02; B05D 5/12

[52] U.S. Cl. ..... 204/227; 204/294; 204/243 R; 204/290 R; 427/113; 427/126.4; 427/376.2; 427/380

[58] Field of Search ..... 205/560; 204/227, 204/294, 279, 243 R, 290 R; 427/113, 126.1, 126.3, 126.4, 294, 314, 376.2, 380, 443.2; 313/327

[56] References Cited

U.S. PATENT DOCUMENTS

| | | | |
|---|---|---|---|
| 2,991,257 | 7/1961 | Smith-Johannsen | 252/506 |
| 3,046,216 | 7/1962 | Lowe | 204/294 |
| 3,083,111 | 3/1963 | Nickerson | 106/56 |
| 3,174,872 | 3/1965 | Fisher et al. | 106/56 |
| 3,442,787 | 5/1969 | Landrum et al. | 204/94 |
| 3,457,158 | 7/1969 | Bullough | 204/243 |
| 3,558,450 | 1/1971 | Ashe, Jr. et al. | 204/59 |
| 4,196,227 | 4/1980 | DuBois et al. | 427/67 |
| 4,235,695 | 11/1990 | De Nora et al. | 204/268 |
| 4,244,986 | 1/1981 | Paruso et al. | 427/126.4 |
| 4,292,345 | 9/1981 | Kolesnik et al. | 427/113 |
| 4,376,690 | 3/1983 | Kugler | 204/243 R |
| 4,427,540 | 1/1984 | Hsu et al. | 208/131 |
| 4,439,382 | 3/1984 | Joo' et al. | 264/29.5 |
| 4,445,996 | 5/1984 | Kawamata et al. | 204/294 |
| 4,466,996 | 8/1984 | Boxall et al. | 427/122 |
| 4,517,037 | 5/1985 | Francis et al. | 156/89 |
| 4,534,837 | 8/1985 | Nicolas et al. | 204/129 |
| 4,560,448 | 12/1985 | Sane et al. | 204/67 |
| 4,582,553 | 8/1986 | Buchta | 156/242 |
| 4,595,545 | 6/1986 | Sane | 264/65 |
| 4,599,320 | 7/1986 | Reeve et al. | 501/96 |
| 4,600,481 | 7/1986 | Sane et al. | 204/67 |
| 4,612,103 | 9/1986 | Dewing et al. | 204/243 R |
| 4,613,418 | 9/1986 | Dewing et al. | 204/243 R |
| 4,683,037 | 7/1987 | Duruz | 204/64 R |
| 4,726,995 | 2/1988 | Chiu | 428/408 |
| 4,737,253 | 4/1988 | Gesing et al. | 204/243 R |
| 4,857,289 | 8/1989 | Nauroth et al. | 423/339 |
| 4,919,771 | 4/1990 | Wilkening | 204/67 |
| 4,921,731 | 5/1990 | Clark et al. | 427/314 |
| 4,931,413 | 6/1990 | Weir et al. | 501/31 |
| 4,935,265 | 6/1990 | Pike | 427/226 |
| 4,944,991 | 7/1990 | Karas et al. | 428/408 |
| 4,983,423 | 1/1991 | Goldsmith | 427/230 |
| 5,071,533 | 12/1991 | De Nora et al. | 204/243 R |
| 5,071,674 | 12/1991 | Nogues et al. | 427/57 |
| 5,135,621 | 8/1992 | de Nora et al. | 204/67 |
| 5,137,749 | 8/1992 | Yamazaki et al. | 427/108 |
| 5,203,971 | 4/1993 | de Nora et al. | 204/67 |
| 5,310,476 | 5/1994 | Sekhar et al. | 205/230 |
| 5,320,717 | 6/1994 | Sekhar | 204/67 |
| 5,340,448 | 8/1994 | Sekhar et al. | 204/67 |
| 5,342,491 | 8/1994 | Sekhar | 204/243 R |
| 5,364,513 | 11/1994 | Sekhar et al. | 204/243 R |
| 5,374,342 | 12/1994 | Sekhar | 204/243 R |
| 5,378,327 | 1/1995 | Sekhar et al. | 204/67 |
| 5,397,450 | 3/1995 | Sekhar et al. | 204/243 R |
| 5,409,589 | 4/1995 | Sekhar | 204/279 |
| 5,413,689 | 5/1995 | de Nora et al. | 204/279 |
| 5,420,084 | 5/1995 | Morel | 501/96 |
| 5,492,604 | 2/1996 | Ray | 205/373 |
| 5,507,933 | 4/1996 | de Nora et al. | 204/243 R |
| 5,527,442 | 6/1996 | Sekhar et al. | 204/243 R |
| 5,534,119 | 7/1996 | Sekhar et al. | 205/372 |
| 5,534,130 | 7/1996 | Sekhar et al. | 205/372 |
| 5,578,174 | 11/1996 | Sekhar | 204/243 R |

FOREIGN PATENT DOCUMENTS

| | | |
|---|---|---|
| 0145412 | 11/1984 | European Pat. Off. . |
| 9325731 | 12/1993 | WIPO . |
| 9424337 | 10/1994 | WIPO . |

OTHER PUBLICATIONS

C. Ozaki and K. Tasumi, Change of the Physical Properties and The Structure in Carbon Materials Under Electrolysis Test, Light Metals 1992, Edited by Euel R. Cutshall, The Minerals, Metals & Materials Society, 1991, pp. 759–764 no month available.

Jilai Xue and Harald A. Oye, Sodium and Bath Penetration Into $TiB_2$–Carbon Cathodes During Laboratory Aluminium Electrolysis, Light Metals 1992, Edited by Euel R. Cutshall, The Minerals, Metals & Materials Society, 1991, pp. 773–778 no month available.

Jörg Mittag, E. Bernhauser and H. Friedli, Sodium, Its Influence on Cathode Life in Theory and Practice, Light Metals 1992, Edited by Euel R. Cutshall, The Minerals, Metals & Materials Society, 1992, pp. 789–793 no month available.

JM. Peyneau, Jr. Gaspard and D. Dumas. B. Samanos, Laboratory Testing of the Expression Under Pressure Due to Sodium Intercalation in Carbon Cathode Materials for Aluminum Smelters, Light Metals 1992, Edited by Euel R. Cutshall, The Minerals, Metals & Materials Society, 1991 no month available.

*Primary Examiner*—Kathryn L. Gorgos
*Assistant Examiner*—Edna Wong
*Attorney, Agent, or Firm*—Dinsmore & Shohl LLP

[57] ABSTRACT

Carbon or carbon-based cathodes and cell bottoms of electrolytic cells for the production of aluminium in particular by the electrolysis of alumina in a molten halide electrolyte such as cryolite, are treated to better resist intercalation of sodium in the cell operating conditions by impregnation and/or coating with colloidal alumina, ceria, cerium acetate, lithia, yttria, thoria, zirconia, magnesia or monoaluminium phosphate followed by drying and heat treatment.

46 Claims, No Drawings

TREATED CARBON OR CARBON-BASED CATHODIC COMPONENTS OF ALUMINUM PRODUCTION CELLS

This is a national stage application of PCT/US93/11380 filed Nov. 23, 1993.

FIELD OF THE INVENTION

This invention relates to carbon or carbon-based cathodic cell components of electrolytic cells for the production of aluminium in particular by the electrolysis of alumina in a sodium-containing molten halide electrolyte such as cryolite.

BACKGROUND ART

Aluminium is produced conventionally by the Hall-Héroult process, by the electrolysis of alumina dissolved in cryolite-based molten electrolytes at temperatures up to around 950° C. A Hall-Héroult reduction cell typically has a steel shell provided with an insulating lining of refractory material, which in turn has a lining of carbon which contacts the molten constituents. Conductor bars connected to the negative pole of a direct current source are embedded in the carbon cathode substrate forming the cell bottom floor. The cathode substrate is usually an anthracite based carbon lining made of prebaked cathode blocks, joined with a ramming mixture of anthracite, coke, and coal tar.

In Hall-Héroult cells, a molten aluminium pool acts as the cathode. The carbon lining or cathode material has a useful life of three to eight years, or even less under adverse conditions. The deterioration of the cathode bottom is due to erosion and penetration of electrolyte and liquid aluminium as well as intercalation of sodium, which causes swelling and deformation of the cathode carbon blocks and ramming mix. In addition, the penetration of sodium species and other ingredients of cryolite or air leads to the formation of toxic compounds including cyanides.

The problems associated with penetration of sodium into the carbon cathode have been extensively studied and discussed in the literature.

Several papers in Light Metals 1992 published by the The Minerals, Metals and Materials Society discuss these problems. A paper "Sodium, Its Influence on Cathode Life in Theory and Practice" by Mittag et al., page 789, emphasises the advantages of using graphitic carbon over anthracite. Reasons for the superiority of graphitic carbon were also set out in a paper "Change of the Physical Properties and the Structure in Carbon Materials under Electrolysis Test" by Ozaki et al, page 759. another paper "Sodium and Bath Penetration into $TiB_2$ Carbon Cathodes During Laboratory Aluminium Electrolysis" by Xue et al, page 773, presented results showing that the velocity of sodium penetration increased with increasing $TiB_2$ content. Another paper "Laboratory Testing of the Expansion Under Pressure due to Sodium Intercalation in Carbon Cathode Materials for Aluminium Smelters" by Peyneau et al, page 801, also discusses these problems and describes methods of measuring the carbon expansion due to intercalation.

There have been several attempts to avoid or reduce the problems associated with the intercalation of sodium in carbon cathodes in aluminum production.

Some proposals have been made to dispense with carbon and instead use a cell bottom made entirely of alumina or a similar refractory material, with a cathode current supply arrangement employing composite current feeders using metals and refractory hard materials. See for example, EP-B-0 145 412, EP-A-0 215 555, EP-B-0 145 411, and EP-A-0 215 590. So far, commercialisation of these promising designs has been hindered due to the high cost of the refractory hard materials and difficulties in producing large pieces of such materials.

Other proposals have been made to re-design the cell bottom making use of alumina or similar refractory materials in such a way as to minimize the amount of carbon used for the cathode—see U.S. Pat. No. 5,071,533. Using these designs will reduce the problems associated with carbon, but the carbon is still subject to attack by sodium during cell start up.

There have been numerous proposals to improve the carbon materials by combining them with $TiB_2$ or other refractory hard materials, see e.g. U.S. Pat. No. 4,466,996. But, as pointed out in the above-mentioned paper of Xoe et al., with each composite materials, the penetration increases with increasing $TiB_2$ content.

WO/93/20027 proposes applying a protective coating of refractory material to a carbon cathode by applying a micropyretic reaction layer from a slurry containing particulate reactants in a colloidal carrier, and initiating a micropyretic reaction. To assist rapid wetting of the cathode by molten aluminium, it was proposed to expose the coated cathode to a flux of molten aluminium containing a fluoride, a chloride or a borate of lithium and/or sodium. This improves the wetting of the cathode by molten aluminium, but does not address the problem of sodium attack on the carbon, which is liable to be increased duet to the presence of $TiB_2$.

No adequate solution has yet been proposed to substantially reduce or eliminate the problems associated with sodium penetration in carbon cathodes, namely swelling especially during cell start-up, displacement of the carbon blocks leading to inefficiency, reduced lifetime of the cell, the production of large quantities of toxic products that must be disposed of when the cell has to be overhauled, and the impossibility to use low density carbon.

SUMMARY OF THE INVENTION

A primary object of the present invention is to improve the resistance of carbon cathodes of aluminium production cells or, more generally, of carbon-containing cathodic components of such cells, to the penetration therein of molten electrolyte components and in particular to intercalation by sodium, thereby improving the resistance of the components to degradation during use.

The invention applies to cathodes or other cathodic cell components made of carbon or other carbon-based microporous materials which have an open porosity which extends to the surfaces of the component which, in use, are exposed to the conditions in the cell.

The term carbon cathode is meant to include both preformed carbon blocks ready to be assembled into a cathode in the bottom of an aluminium production cell, as well as installed cathodes forming the cell bottom and the carbon side walls extending up from the bottom and which are also cathodically polarized and therefore subject to attack by sodium from the molten cell content. Other carbon cathodic components include weirs and baffles secured on the cell bottom.

The invention provides a method of treating carbon-based cathodic components of electrolytic cells for the production of aluminium in particular by the electrolysis of alumina in a sodium-containing molten halide electrolyte such as cryolite, in order to improve their resistance to attach in the aggressive environment in the cells, in particular their resistance to intercalation by sodium.

The method according to the invention comprises impregnating and/or coating the cathodic cell component with colloidal alumina, ceria, cerium acetate, silica, lithia, yttria, thoria, zirconia, magnesia or monoaluminium phosphate and drying the colloid-impregnated component. Colloidal alumina is preferred, and mixtures of colloidal alumina with the other colloids can also be used.

The method also includes optionally coating the surface of the component, or including in the surface of the component, an aluminium-wettable refractory material, such as titanium diboride. In this case, the material of the component under the aluminium-wettable refractory material must be impregnated with the colloid, in order to provide an effective barrier to penetration of sodium species.

Thus, when the component is coated with colloid, the colloid coating may optionally contain aluminium-wettable refractory components such as titanium diboride provided the component is impregnated with colloid in order to provide a barrier to sodium penetration. But the colloid coating may be devoid of aluminium-wettable refractory components particularly in the case where the component is coated with, for example, "thick" colloidal alumina, in which case the coating already provides a barrier to sodium penetration at the surface and the colloid need not penetrate so deeply into the carbon or carbon-based material.

Such impregnation and/or coating the carbon or carbon-based component, in particular with colloidal alumina, has been found to improve the resistance of the carbon to damage by sodium impregnation due to the fact that the colloids are stabilized by sodium or other monovalent ions. This stabilization, which occurs during use of the component in the cathodic environment of the aluminium production cell, makes the diffusion of fresh sodium difficult. Such stabilization is particularly effective when the sodium attack occurs through micropores in the carbon or carbon-based material. Therefore, to optimize the protective effect, it is preferred to impregnate the microporous carbon or carbon-based material with the colloid.

In addition, the colloid impregnation and/or coating prevents or inhibits cryolite penetration due to the fact that sodium impregnation in the surface generally makes the carbon or carbon-based material more wettable by cryolite. By limiting sodium penetration to the colloid surface, this enhances wettability of the surface by cryolite, which assists in keeping the cryolite at the surface. Hence, the enhanced resistance to sodium penetration unexpectedly is associated with an enhanced protection against damage by cryolite penetration.

This surprising synergistic effect leads to several further advantages. For example, as a consequence of the inhibition of sodium and cryolite penetration into the bulk of the carbon or carbon-based material, the formation of toxic components is greatly reduced.

Furthermore, the colloid impregnated in the carbon or carbon-containing surface, or coated on the surface, improves the resistance of the carbon or carbon-based material to abrasion by sludge that deposits on the cathode surface and may move with the cathodic pool of aluminium and thereby wear the surface.

Also, by protecting the carbonaceous cell components from attach by NaF or other aggressive ingredients of the electrolyte, the cell efficiency is improved. Because NaF in the electrolyte no longer reacts with the carbon cell bottom and walls, the cell functions with a defined bath ratio without a need to replenish the electrolyte with NaF.

Impregnation and/or coating of the component is preferably followed by a heat treatment and may also be enhanced by preceding it with a heat treatment, for example at about 1000° C. Sometimes, a single impregnation suffices, but usually the impregnation and drying steps are repeated until the component is saturated with the colloid. Generally, impregnation will take place when the viscosity of the colloid is low, and the number of impregnations needed to saturate the material can be determined by measuring the weight gain. Coating will take place when the colloid is thicker, i.e. paste-like. Impregnation with a low-viscosity colloid can be followed by coating with a pasty colloid.

The component is conventionally impregnated by dipping it into the colloid, which can take place in ambient conditions, but the impregnation may be assisted by the application of a pressure differential, by applying pressure or a vacuum. Coating can be by dipping or other application techniques such as brushing.

The colloid may be derived from colloid precursors and reagents which are solutions of at least one salt such as chlorides, sulfates, nitrates, chlorates, perchlorates or metal organic compounds such as alkoxides, formates, acetates and mixtures thereof. The aforementioned solutions of metal organic compounds, principally metal alkoxides, may be of the general formula $M(OR)_z$ where M is a metal or complex cation, R is an alkyl chain and z is a number usually from 1 to 12.

The colloid usually has a dry colloid content corresponding to up to 50 weight % of the colloid plus liquid carrier, preferably from 10 to 20 weight %. The liquid carrier is usually water but could be non-aqueous.

The carbon or carbon-based microporous material making up the cathode or cathodic component usually has an open porosity usually from 5% to 40%, often from about 15% to about 30%. Such microporous materials are in particular liable to be attached by the corrosive cell contents at the high operating temperatures. Impregnation of the pores with a selected colloid greatly increases the materials' resistance to corrosion, as set out above.

It is advantageous for the carbon or other carbon-based microporous material making up to the cathode or the cathodic component to be impregnated with alumina or with colloidal monoaluminium phosphate which will be converted to alumina.

Especially when the electrolyte in the aluminium production cell contains cerium, for instance cryolite containing cerium which maintains a protective cerium oxyfluoride coating on the anode, the carbon-based cathode component may be impregnated and/or coated with a cerium-based colloid, typically comprising at least one of colloidal ceria and colloidal cerium acetate. This cerium-based colloidal carrier may further comprise colloidal alumina or other colloids such as yttria, silica, thoria, zirconia, magnesia, lithia and/or monoaluminium phosphate. Colloid cerium impregnated in the microporous carbon or carbon-based material improves its performance when used as cathode or cell lining, while the cerium-based colloid is compatible with a cerium-containing fluoride-based electrolyte.

One advantageous impregnating agent greatly improving the material's resistance to penetration by sodium from the molten content of the cell, is colloidal lithia. The liquid carrier of the colloid, preferably colloidal alumina and/or colloidal lithia, is a solution containing at least one compound of lithium, sodium and potassium, preferably a lithium compound. Impregnation of carbon cathodes with colloidal lithia and/or with a colloid in a solution of a lithium, sodium or potassium salt, followed by heat treatment greatly improves the cathodes resistance to sodium impregnation, as taught in copending application Ser. No. 08/028384 (MOL0515) the contents whereof are incorporated herein by way of reference.

A colloid impregnated cathode or cathodic component according to the invention can also be coated with a protective coating, typically containing an aluminium-wettable refractory hard metal compound such as the borides and carbides of metals of Group IVB (titanium, zirconium, hafnium) and Group VB vanadium, niobium, tantalum), usually applied after impregnation of the carbon or carbon-based material with the colloid.

Such a protective coating may be formed by applying to the treated carbon cathode a micropyretic reaction layer from a slurry containing particulate reactants in a colloidal carrier, and initiating a micropyretic reaction as described in WO/93/20027, the contents whereof are incorporated herein by way of reference. Such micropyretic slurry comprises particulate micropyretic reactants in combination with optional particulate of fibrous non-reactant fillers or moderators in a carrier of colloidal materials or other fluids such as water or other aqueous solutions, organic carriers such as acetone, urethanes, etc., or inorganic carriers such as colloidal metal oxides. Such coatings may give an additional protection against sodium attack.

Protective coatings can also be formed from a colloidal slurry of particulate non-reactants, such as preformed $TiB_2$, as described in WO/93/20026, the contents whereof are incorporated herein by way of reference.

Such protective coatings applied directly to a carbon or carbon-based material in a colloidal carrier have good adherence to the substrate and good wettability by molten aluminium. However, as discussed in the Background Art section, the presence of aluminium-wettable refractory material such as titanium diboride enhances the penetration of sodium and inhibits the potential beneficial effect of the colloid as a barrier to sodium penetration. For this reason, components coated with aluminium-wettable refractory materials must be impregnated with the colloid in order to inhibit sodium penetration in accordance with the invention.

When the impregnated carbon or carbon-based cathode or cathodic component is coated with a refractory coating forming a cathodic surface in contact with the cathodically-produced aluminium, it can be used as a drained cathode. The refractory coating forms the cathodic surface on which the aluminium is deposited cathodically usually with the component arranged upright or at a slope for the aluminium to drain from the cathodic surface.

It is advantageous for cathodes or cell bottoms of low density carbon to be impregnated with a colloid according to the invention, low density carbon embraces various types of relatively inexpensive forms of carbon which are relatively porous and very conductive, but hitherto could not be used successfully in the environment of aluminium production cells on account of the fact that they were subject to excessive corrosion or oxidation. Now it is possible, by impregnating these low density carbons with a colloid according to the invention, to make use of them in these cells instead of the more expensive high density anthracite and graphite, taking advantage of their excellent conductivity and low cost.

The cathode or cathodic components may, for instance, be made of petroleum coke, metallurgical coke, anthracite, graphite, amorphous carbon, fullerene such as fullerene $C_{60}$ or $C_{70}$ or of a related family, low density carbon or mixtures thereof. Most usually, the component will be made of the usual grades of carbon used as cathodes in conventional Hall-Héroult cells.

The material making up the component may also be a carbon-based composite material comprising carbon and at least one further component selected from refractory oxycompound, in particular alumina, and possibly also refractory hard metal borides, carbides and silicides, in particular titanium diboride, it being understood that any aluminium-wettable refractory material will be adjacent to the surface in which case the underlying carbon or carbon-based material will be impregnated with the colloid. Examples of such composite materials are described in copending application PCT/US93/05459 (MOL0512) the contents whereof are incorporated herein by way of reference.

The component of the invention may be a carbon cathode or a carbon cell bottom or lining advantageously impregnated with dried colloidal alumina and coated with a protective coating comprising a Refractory Hard Metal boride.

Alternatively the component may be a carbon cathode or a carbon cell bottom or lining impregnated and coated with dried colloidal alumina.

A further aspect of the invention is an electrolytic cell for the production of aluminium, in particular by the electrolysis of alumina in a sodium-containing molten halide electrolyte such as cryolite, comprising a cathodic component made of carbon or a carbon-based material, wherein the component is impregnated and/or coated with colloidal alumina, ceria, cerium acetate, silica, lithia, yttria, thoria, zirconia, magnesia or monoaluminium phosphate, as set out above.

The invention also concerns a method of producing aluminium by the electrolysis of alumina dissolved in molten cryolite in a cell having a colloid impregnated and/or coated carbon cathode as set out above; an electrolytic cell for producing aluminium by the electrolysis of alumina dissolved in molten cryolite provided with such a colloid impregnated and/or coated carbon; a method of conditioning carbon cathodes for use in such cells; as well as a method of reconditioning these electrolytic cells. The electrolyte may be cryolite or modified forms of cryolite in particular containing LiF, and may be at the usual operating temperature of about 950° C., or lower temperatures.

DETAILED DESCRIPTION

The invention will be further described in the following examples.

EXAMPLE 1

Samples of cathode-grade carbon were impregnated with colloidal alumina by dipping them in Nyacol™ colloidal alumina containing 20 wt % alumina for 5 minutes, removing them and air drying in an oven for 1 hour at 200° C. This produced a weight uptake of approximately 1.7%. The dipping process was repeated, but there was no further weight uptake, indicating that the sample was saturated with alumina.

These impregnated samples and corresponding non-impregnated samples were then subjected to a sodium penetration test. This test consisted of cathodically polarizing the samples in an approximately 33/67 wt % sodium fluoride/sodium chloride electrolyte at about 710° C. and at a current density of 0.15 A/cm$^2$ or 0.1 A/cm$^2$ for variable test periods, usually between 5 and 10 hours. These test conditions simulate the effects of sodium penetration in commercial working conditions over much longer periods.

The impregnated samples showed a higher resistance to sodium penetration than the non-impregnated samples which showed signs of substantial degradation after only about 3 hours.

Several of the impregnated samples were sectioned and submitted to analyses to determine the extent of alumina penetration. Alumina was detected uniformly through the sample to a depth of 10 mm, corresponding to the center of the sample. The samples had a random distribution of narrow pores from the sample surface to a depth of 1 mm. Impregnation to the center of the sample took place through an interconnected inner pore system, in the carbon.

EXAMPLE 2

Several of the colloid-impregnated samples of Example 1 were further coated with a $tiB_2$ coating as follows.

A slurry was prepared from a dispersion of 10 g $TiB_2$, 99.5% pure, −325 mesh (<42 micrometer), in 25 ml of colloidal alumina containing about 20 weight % of solid alumina. Coatings with a thickness of 150±50 to 500±50 micrometer were applied to the faces of carbon blocks. Each layer of slurry was allowed to dry for several minutes before applying the next, followed by a final drying by baking in an oven at 100°–150° C. for 30 minutes to 1 hour.

The above procedure was repeated varying the amount of $TiB_2$ in the slurry from 5 to 15 g and varying the amount of colloidal alumina from 10 ml to 40 ml. Coatings were applied as before. Drying in air took 10 to 60 minutes depending on the dilution of the slurry and the thickness of the coatings. In all cases, an adherent layer of $TiB_2$ was obtained.

The colloid-impregnated $TiB_2$-coated samples showed an even higher resistance to sodium penetration than the colloid-impregnated uncoated samples, when submitted to the same sodium penetration test. These coated samples additionally exhibited improved wettability by molten aluminium. Compared to non-impregnated samples coated in the same way, the impregnated and coated samples showed a better resistance to sodium penetration.

EXAMPLE 3

40 ml 10% HCl in aqueous solution was added to 50 g of a petroleum coke based particulate mixture and stirred for a sufficient time to wet the petroleum coke particles, followed by drying at 200° C. for approximately 2 hours to dry the petroleum coke completely. The particulate mixture was made of 84 wt % petroleum coke (1–200 micrometer), 15 wt % $Al_2O_3$ (3 micrometer) and 1 wt % $B_2O_3$ (1 micrometer).

80 ml of colloidal alumina (AL-20 grade, 20% solid alumina) was added to the dried acidified petroleum coke based mixture and stirred well. The resulting slurry of petroleum coke, particulate alumina, colloid alumina and HCl mixture was then dried at 200° C. in an air furnace for approximately 2 to 3 hours to produce a paste.

The resulting paste was pressed at 57 mPa into cylinder form. In the pressing process, some liquid was squeezed out. The cylinders were then held at 200° C. in an air furnace until dried. The resulting material was a microporous carbon/alumina composite.

A specimen produced this way was impregnated with colloidal cerium acetate by dipping the dried cylinder in the colloid, then drying it again at 200° C.

Compared to non-impregnated cylinders, impregnated cylinders prepared this way were found to have enhanced resistance to sodium penetration when used as cathodes in a laboratory scale aluminium production cell.

EXAMPLE 4

The above Examples can be repeated including in the liquid carrier of the colloid at least one compound of lithium, aluminium, cerium, calcium, sodium and/or potassium, preferably a soluble compound.

The lithium compound may be lithium acetate, lithium carbonate, lithium fluoride, lithium chloride, lithium oxalate, lithium nitride, lithium nitrate, lithium formate and lithium aryl, lithium tetraborate and mixtures thereof.

The aluminium compound is preferably a soluble compound, but some insoluble compounds can also be used. Soluble compounds include aluminium nitrate, carbonate, halides and borate. Insoluble aluminium carbide can also be used.

Preferably, there is at least one of these lithium compounds together with at least one of these aluminium compounds. These compounds react together and, when the component is made of carbon, with the carbon to form aluminium oxycarbide and/or aluminium carbide $Al_4C$ which act as an oxidation-resistant and electrically-conductive binder for the carbon and contribute to the great oxidation resistance of the material and make it wettable by molten cryolite. Altogether, the addition of these lithium and aluminium compounds greatly increases the stability of the material in the environment of an aluminium production cell.

For instance, a solution can be prepared by thoroughly mixing 5 g of $AlNO_3.9H_2O$(98%) and 5 g of $LiNO_3$(99%) in 50 ml of water, and this carrier solution then mixed with colloidal alumina to provide a solid alumina colloid content of about 10 to 20 weight % of the total. Cathode grades of carbon impregnated with this reagent-containing colloidal alumina followed by heat treatment at about 1000° C. show improved stability and greater resistance to penetration by sodium.

I claim:

1. A method of conditioning a pre-formed carbon or carbon-based component of an electrolytic cell for the production of aluminium, by the electrolysis of alumina in a sodium-containing molten halide electrolyte, to improve the resistance of the carbon to damage by the penetration therein of sodium, wherein the method comprises:

treating by impregnating, coating or impregnating and coating the surface of the component subject to sodium penetration with a colloidal material consisting essentially of a liquid carrier containing at least one colloid selected from the group consisting of colloidal alumina, ceria, cerium acetate, silica, lithia, yttria, thoria, zirconia, magnesia, monoaluminium phosphate and mixtures thereof;

drying the colloid-impregnated, coated or impregnated and coated component; and stabilizing said colloids in-situ by exposure to sodium or other monovalent ions.

2. The method of claim 1, wherein said treatment of the component is followed by a heat treatment.

3. The method of claim 2, wherein said treatment of the component is preceded by a heat treatment.

4. The method of claim 1, wherein the impregnating and drying steps are repeated until the component is saturated with the colloid.

5. The method of claim 1, wherein the component is impregnated by dipping the component into the colloid.

6. The method of claim 1, wherein impregnation is assisted by the application of pressure or a vacuum.

7. The method of claim 1, wherein the component is impregnated, coated or impregnated and coated with colloidal alumina.

8. The method of claim 1, wherein the component is impregnated, coated or impregnated and coated with a cerium-containing colloid.

9. The method of claim 8, wherein the cerium-containing colloid is selected from the group consisting of colloidal ceria and colloidal cerium acetate and further comprises at least one colloid selected from the group consisting of colloidal alumina, lithia, yttria, silica, thoria, zirconia, magnesia and monoaluminium phosphate.

10. The method of claim 1, wherein the colloid is contained in the liquid carrier which further contains at least one compound selected from the group consisting of compounds of lithium, aluminium, cerium, calcium, sodium and potassium.

11. The method of claim 10, wherein the liquid carrier contains at least one compound of lithium and at least one compound of aluminium.

12. The method of claim 1, wherein the colloid is derived from colloid precursors and reagents which are solutions of at least one salt selected from the group consisting of chlorides, sulfates, nitrates, chlorates, perchlorates, metal organic compounds and mixtures thereof.

13. The method of claim 12, wherein the solutions of metal organic compounds are of the general formula $M(OR)_z$ where M is a metal or complex cation, R is an alkyl chain and z is a number usually from 1 to 12.

14. The method of claim 12, wherein said metal organic compounds are selected from the group consisting of alkoxides, formates, acetates and mixtures thereof.

15. The method of claim 1, wherein the colloid has a dry colloid content corresponding to up to 50 weight % of the colloid plus liquid carrier.

16. The method of claim 15, wherein said dry colloid content ranges from 10 to 20 weight % of the colloid plus liquid carrier.

17. The method of claim 1, wherein the carbon or carbon-based component has an open porosity from 5% to 40%.

18. The method of claim 1, wherein impregnation of the component with colloid is followed by the application of a protective coating of an aluminium-wettable refractory material.

19. The method of claim 18, wherein the protective coating comprises a refractory hard metal boride.

20. The method of claim 1, wherein the colloid impregnated or coated component is a cell bottom or lining.

21. The component of claim 20, which is a carbon cell bottom or lining impregnated with dried colloidal alumina and coated with a protective coating comprising a refractory hard metal boride.

22. A pre-formed carbon or carbon-based cathodic component of an electrolytic cell for the production of aluminium by the electrolysis of alumina in a sodium-containing molten halide electrolyte, wherein at least one surface of the component which, in use, is exposed to the conditions in the cell is impregnated, coated or impregnated and coated with a material consisting essentially of a dried colloid selected from the group consisting of dried colloidal alumina, ceria, cerium acetate, silica, lithia, yttria, thoria, zirconia, magnesia, monoaluminium phosphate and mixtures thereof, wherein said colloid is stabilized by sodium or other monovalent ions.

23. The component of claim 22, wherein the component has a microporous surface saturated with the dried colloid.

24. The component of claim 22, which is impregnated, coated or impregnated and coated with colloidal alumina.

25. The component of claim 22, which is impregnated, coated or impregnated and coated with a dried cerium-containing colloid.

26. The component of claim 25, wherein the cerium-containing colloid is selected from the group consisting of colloidal ceria and colloidal cerium acetate and further comprises at least one colloid selected from the group consisting of colloidal alumina, lithia, yttria, silica, thoria, zirconia, magnesia and monaluminium phosphate.

27. The component of claim 22, wherein the colloid is dried from a liquid carrier which further contains at least one compound selected from the group consisting of compounds of lithium, aluminium, cerium, calcium, sodium and potassium.

28. The component of claim 27, wherein the colloid is dried from a liquid carrier which further contains at least one compound of lithium and at least one compound of aluminium.

29. The component of claim 22 wherein the colloid is derived from colloid precursors and reagents which are solutions of at least one salt selected from the group consisting of chlorides, sulfates, nitrates, chlorates, perchlorates, a metal organic compounds and mixtures thereof.

30. The component of claim 29, wherein the solutions of metal organic compounds are of the general formula $M(OR)_z$ where M is a metal or complex cation, R is an alkyl chain and z is a number from 1 to 12.

31. The component of claim 29 wherein the metal organic compound is selected from the group consisting of alkoxides, formates, acetates and mixtures thereof.

32. The component of claim 22, wherein the carbon or carbon-based component has an open porosity from 5% to 40%.

33. The component of claim 22, wherein a colloid-impregnated component is coated with a protective coating of an aluminium-wettable refractory material.

34. The component of claim 33, wherein the protective coating comprises a refractory hard metal boride.

35. The component of claim 34, which is a colloid-impregnated, coated or impregnated and coated cell bottom or lining.

36. The component of claim 22, made of carbon impregnated, coated or impregnated and coated with the colloid.

37. The component of claim 22, made of colloid impregnated, coated or impregnated and coated carbon or carbon-based composite material comprising carbon and at least one further component selected from refractory oxy-compounds and aluminium-wettable refractory materials wherein when the composite material includes an aluminium-wettable refractory material said aluminium-wettable refractory material is at the surface of the composite material and the carbon or carbon-based material under the aluminium-wettable refractory material is impregnated with the colloid.

38. The component of claim 37, wherein said oxycompound is alumina and said refractory material is titanium diboride.

39. The component of claim 22, which is a carbon cathode impregnated with dried colloidal alumina and coated with a protective coating comprising a refractory hard metal boride.

40. The component of claim 22, which is a carbon bottom or lining impregnated and coated with dried colloid alumina.

41. The component of claim 22, which is a carbon cell bottom or lining impregnated and coated with dried colloid alumina.

42. An electrolytic cell for the production of aluminium, by the electrolysis of alumina in a sodium-containing molten halide electrolyte comprising a carbon or carbon-based cathodic component impregnated, coated or impregnated and coated with a material which consists essentially of a dried colloid selected from the group consisting of dried colloidal alumina, ceria, cerium acetate, silica, lithia, yttria, thoria, zirconia, magnesia or monoaluminium phosphate and mixtures thereof, wherein said colloid is stabilized by sodium or other monovalent ions.

43. The cell of claim 42, wherein the component is a carbon cathode impregnated with dried colloidal alumina and coated with a protective coating comprising a refractory hard metal boride.

44. The cell of claim 42, wherein the component is a carbon cell bottom or lining impregnated with dried colloidal alumina and coated with a protective coating comprising a refractory hard metal boride.

45. The cell of claim 42 wherein the component is a carbon cathode impregnated and coated with dried colloidal alumina.

46. The cell of claim 42, wherein the component is a carbon cell bottom or lining impregnated and coated with dried colloidal alumina.

* * * * *